US007277109B2

(12) United States Patent
Ueda

(10) Patent No.: US 7,277,109 B2
(45) Date of Patent: Oct. 2, 2007

(54) THERMAL TRANSFER PRINTER

(75) Inventor: Hideo Ueda, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 314 days.

(21) Appl. No.: 11/171,261

(22) Filed: Jul. 1, 2005

(65) Prior Publication Data

US 2006/0007295 A1 Jan. 12, 2006

(30) Foreign Application Priority Data

Jul. 7, 2004 (JP) ..... 2004-200427

(51) Int. Cl.
*B41J 2/325* (2006.01)

(52) U.S. Cl. ..... 347/177

(58) Field of Classification Search ..... 347/176, 347/177, 171; 400/249, 120.04, 615.2
See application file for complete search history.

(56) References Cited

U.S. PATENT DOCUMENTS 5,445,464 A * 8/1995 Asakura et al. ..... 400/249
5,829,897 A * 11/1998 Murai ..... 400/615.2
6,121,987 A * 9/2000 Sasaki et al. ..... 347/176

FOREIGN PATENT DOCUMENTS

JP 2000-263905 9/2000

* cited by examiner

*Primary Examiner*—K. Feggins
(74) *Attorney, Agent, or Firm*—Crowell & Moring LLP

(57) ABSTRACT

In a thermal transfer printer, before a thermal head transfers an ink component of a yellow region on a recording paper, the thermal head is preheated up to a transfer temperature and by sublimating a black ink component constituting a mark pattern during preheating, records used information in the mark pattern. After turn-on of an electric power, when an optical sensor reads the used information, an ink ribbon driving mechanism is driven until the optical sensor detects the rear mark pattern in which the used information is not recorded to locate the start of an unused region of an ink ribbon. Thus, residual amount of the ink ribbon is grasped accurately and the start of the unused region is located accurately without increasing the costs of ink ribbon.

7 Claims, 6 Drawing Sheets

THERMAL TRANSFER PRINTER

BACKGROUND OF THE INVENTION

1. Field of the Invention

The present invention relates to a thermal transfer printer for thermally transferring an ink applied on an ink ribbon on a recording paper.

2. Description of Related Art

Conventionally, in thermal transfer printers, to inform the user of the need for changing an ink ribbon soon, various mechanisms for detecting residual quantity of the ink ribbon have been studied. For example, a thermal transfer printer in which residual quantity of the ink ribbon is calculated by measuring the outer diameter of a feed roll has been proposed. A thermal transfer printer in which residual quantity data indicating residual quantity is formed on the ink ribbon in advance and the residual quantity data is read by an optical sensor or the like has been also proposed.

However, since thickness of the ink ribbon is very thin in the thermal transfer printer in which the outer diameter of the feed roll is measured, an error of the residual quantity calculated based on the outer diameter becomes large and thus residual quantity cannot be calculated accurately. Furthermore, the printer in which the residual quantity data formed on the ink ribbon is read has a problem of causing increase in cost of the ink ribbon.

Thus, as distinct from the above-mentioned thermal transfer printers, a thermal transfer printer in which the number of revolutions of a feed roll or take-up roller is counted by an encoder attached to an revolving shaft of the feed roll or take-up roller and residual quantity of the ink ribbon is calculated based on the accumulated number of revolutions has been put to practical use. In such thermal transfer printer, however, for example, when the ink ribbon is detached after printing images several times and replaced with another used ink ribbon, residual quantity of the ink ribbon cannot be grasped accurately. Alternatively, when the ink ribbon intentionally wound back by the user is loaded, the start of an unused region cannot be located and thus printing is performed by using a region already used for printing. As a result, normal printing cannot be ensured.

In another known thermal transfer printer, a transparent heat-sensitive zone is provided at the ink ribbon and use of an ink ribbon having a different color reproduction property can be prevented by deciding presence or absence of a discrimination mark formed on the transparent heat-sensitive zone (see Japanese Laid-Open Patent Publication No. 2000-263905, for example). In such a thermal transfer printer, provision of the transparent heat-sensitive zone in the ink ribbon necessarily causes increase in cost of the ink ribbon.

SUMMARY OF THE INVENTION

To solve the above-mentioned problems, the present invention intends to provide a thermal transfer printer capable of perform normal printing by grasping residual quantity of an ink ribbon accurately and locating the start of an unused region of the ink ribbon.

A thermal transfer printer in accordance with an aspect of the present invention comprises: at least one ink ribbon drive mechanism for rotationally driving a feed roll and a take-up roll around which a long ink ribbon on which an ink component and a transparent coating component are sequentially formed in its longitudinal direction; a thermal head for thermally transferring at least one ink component and coating component on a recording paper and forming an image on the recording paper by heating the ink ribbon; and a control means for controlling each part.

A mark pattern for aligning the ink ribbon with respect to the thermal head is formed in each gap between the coating component and an ink component of the ink ribbon. An optical sensor for reading the mark pattern is provided in the vicinity of the thermal head.

Before the thermal head thermally transfers the ink component on the recording paper, the control means makes the mark pattern record predetermined information by sublimating a part of the mark pattern adjacent to a region of the ink component. When the optical sensor reads the predetermined information from the mark pattern, the control means detects a front end of an unused region of the ink ribbon based on the information.

According to the invention, since the used information is recorded in the mark pattern formed on the ink ribbon, even when the ink ribbon intentionally wound back by the user is loaded, before image formation, the start of the unused region can be located and normal printing can be performed. Furthermore, by counting the used information read by the optical sensor, residual quantity of the ink ribbon can be calculated accurately. Still furthermore, since the used information is recorded in the first mark pattern for alignment, which is originally formed on the ink ribbon, no increase in cost of the ink ribbon occurs.

DETAILED DESCRIPTION OF THE EMBODIMENT

Figure 1:
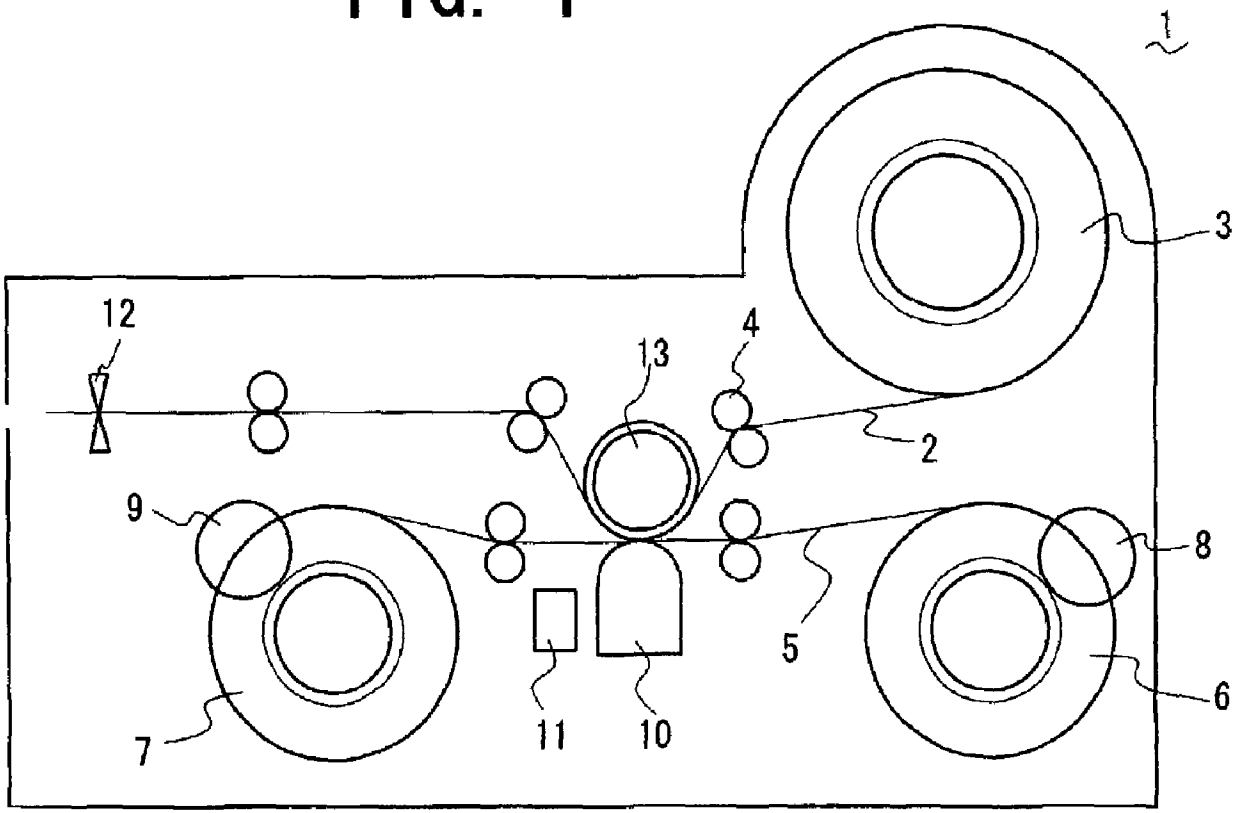
FIG. 1 is a view showing a schematic configuration of a thermal transfer printer in accordance with an embodiment of the present invention.
Figure 2:
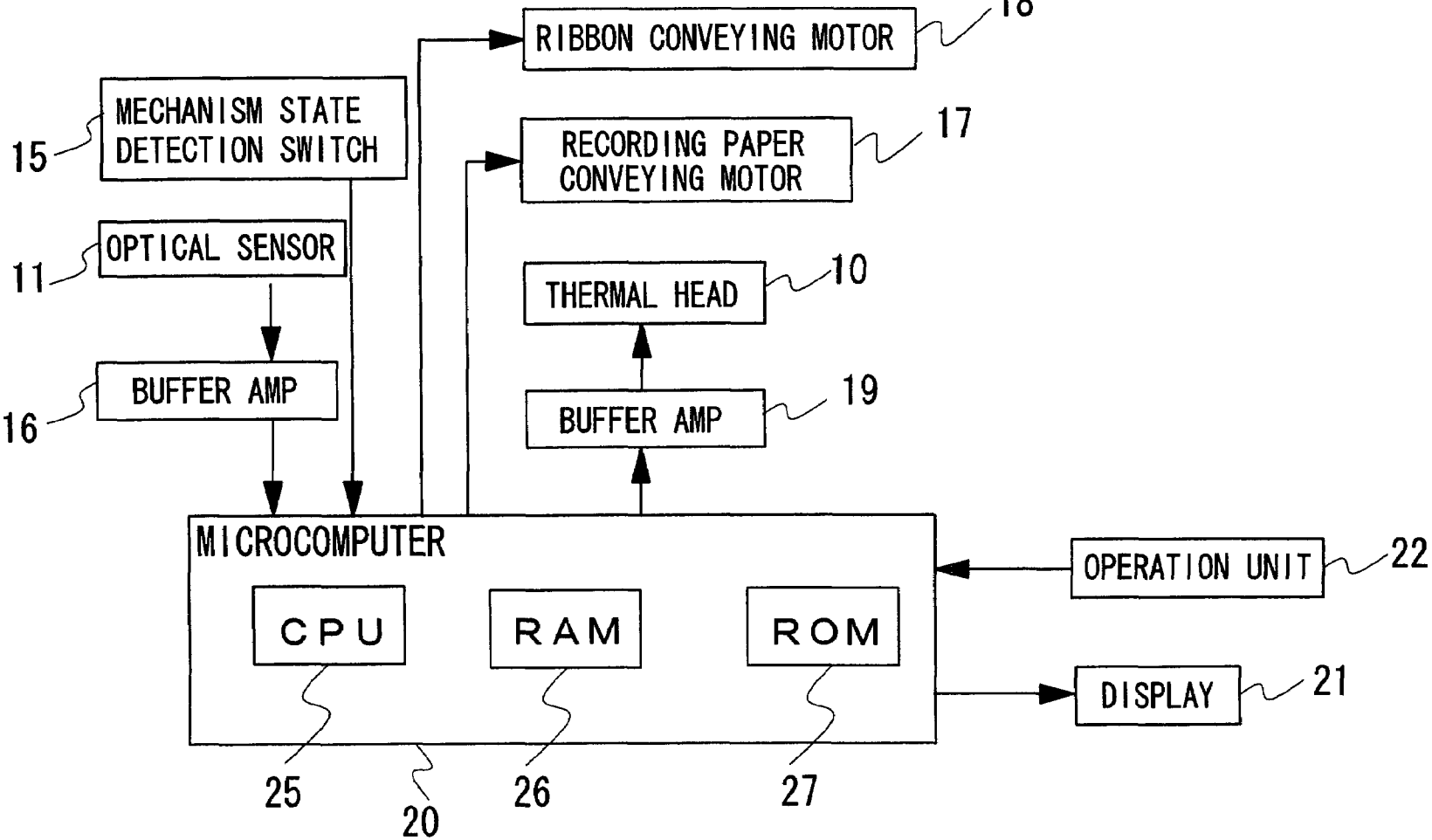
FIG. 2 is a block diagram showing an electrical configuration of the printer.

A thermal transfer printer in accordance with a preferred embodiment for carrying out the present invention will be described with reference to figures. FIG. 1 schematically shows a mechanical configuration of a thermal transfer printer in accordance with the embodiment and FIG. 2 shows an electrical configuration of the thermal transfer printer.

The thermal transfer printer (hereinafter, referred to as a printer) 1 is comprised of a recording paper roll 3 formed of a long recording paper 2 wound around a cylindrical core, a recording paper conveying mechanism 4 for conveying the recording paper 2 sent from the recording paper roll 3 in its longitudinal direction, a feed roll 6 and a take-up roll 7 around which a long ink ribbon 5 on which an ink component is applied is wound, ink ribbon drive mechanisms 8 and 9 for rotationally driving the feed roll 6 and take-up roll 7, a thermal head 10 for thermally transferring the ink component of the ink ribbon 5 to form an image on the recording paper 2, an optical sensor 11 disposed in the vicinity of the thermal head 10 and a cutter 12 for cutting the recording paper 2 on which the image is recorded by the thermal head 10.

The thermal head 10 transfers the ink component on the recording paper 2 by heating the ink ribbon 5 while pressing the recording paper 2 conveyed from the recording paper conveying mechanism 4 and the ink ribbon 5 conveyed from the ink ribbon drive mechanisms 8 and 9 onto a platen roller 13. The ink ribbon 5 is heated by applying power to an array of micro heating sections arranged in the direction perpendicular to the direction of conveying the ink ribbon 5. The optical sensor 11 is provided at downstream side or upstream side from the thermal head 10 to read mark patterns 35, 36, 37 and 38 (refer to FIGS. 3 and 4) as references in aligning the ink ribbon 5 with respect to the thermal head 10. The cutter 12 cuts the recording paper 2 on which an image is recorded by the thermal head 10 according to size of the image.

The printer 1 has a mechanism state detection switch 15 for detecting whether the recording paper roll 3 is loaded to the printer 1 or not and whether the feed roller 6 and take-up roller 7 are loaded to the printer 1 or not, a buffer amplifier 16 for accumulating and inputting an electric signal output from the optical sensor 11 to a microcomputer 20, a recording paper conveying motor 17 for outputting rotational drive force to the recording paper conveying mechanism 4, a ribbon conveying motor 18 for outputting rotational drive force to the ink ribbon drive mechanisms 8 and 9, a buffer amplifier 19 for accumulating and inputting an electric signal output from the microcomputer 20 to the thermal head 10, the microcomputer 20 for controlling each part of the printer 1, a display device 21 for displaying various information concerning the operation of the printer 1 and a key operation unit 22 for inputting various instructions to microcomputer 20. The microcomputer 20 has a CPU 25 for executing various arithmetic processing and a RAM 26 and a ROM 27 for storing data necessary for the operation of the CPU 25 therein.

Figure 3:
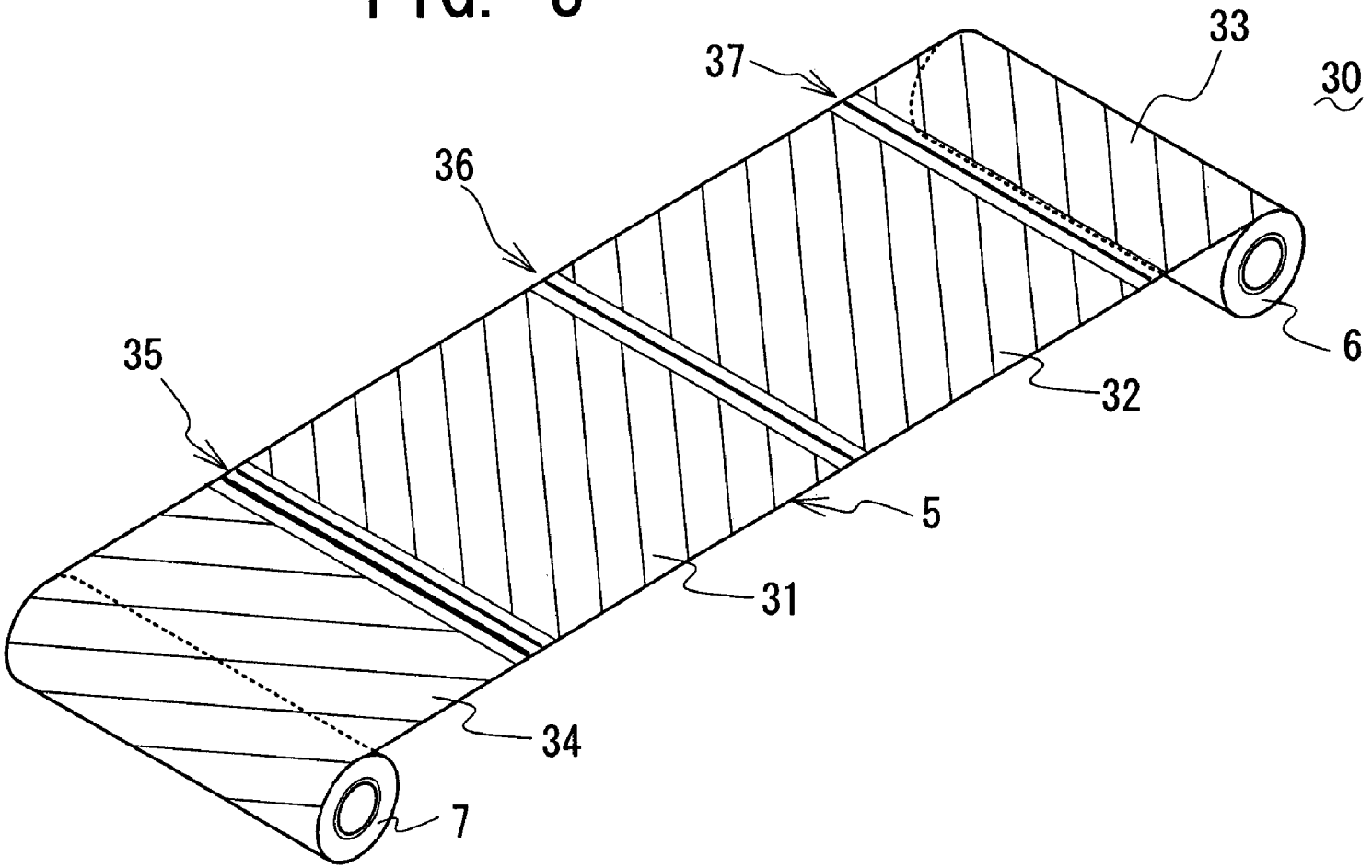
FIG. 3 is a perspective view showing an ink ribbon feeding mechanism used for the printer.

FIG. 3 shows an ink ribbon feed mechanism 30 comprised of the ink ribbon 5 and feed roll 6 and take-up roll 7. Ink components of colors of yellow, magenta and cyan for forming a color image and a transparent coating component are each applied in succession repeatedly and they constitute a yellow region 31, a magenta region 32, a cyan region 33 and a clear region 34, respectively. By using a set of the yellow region 31, magenta region 32, cyan region 33 and clear region 34, one sheet of color image can be formed on the recording paper 2.

The clear region 34 and yellow region 31 that are adjacent to each other are formed with a predetermined gap therebetween and two strips of black ink component are applied in the gap to constitute the first mark pattern 35. The first mark pattern 35 is formed in the direction perpendicular to the longitudinal direction of the ink ribbon 5. Furthermore, the yellow region 31 and magenta region 32, cyan region 33, and clear region 34 that are adjacent to each other are each formed with a predetermined gap therebetween and one strip of black ink component is applied in the gaps to constitute the second mark patterns 36, 37 and 38 (refer to FIG. 4). These second mark patterns 36, 37 and 38 are also formed in the direction perpendicular to the longitudinal direction of the ink ribbon 5.

The procedure for forming an image in the printer 1 will be described. First, in the printer 1, the ink ribbon 5 is positioned so that the first mark patter 35 is opposed to the thermal head 10 and the thermal head 10 is preheated (refer to FIG. 4). When preheating of the thermal head 10 is finished, the ink ribbon 5 is conveyer by driving the ink ribbon drive mechanism 9 and power is applied to the thermal head 10 while the yellow region 31 is made opposed to the thermal head 10 from its front end to its rear end sequentially to thermally transfer the yellow ink component on the recording paper 2. Thus, a yellow image is formed on the recording paper 2. Then, the recording paper 2 is wound back once by the recording paper conveying mechanism 4 and the ink ribbon 5 is aligned with respect to the thermal head 10. Then, the ink ribbon 5 is conveyed by driving the ink ribbon drive mechanism 9 and power is applied to the thermal head 10 while the magenta region 32 is made opposed to the thermal head 10 from its front end to its rear end sequentially to thermally transfer the magenta ink component on the recording paper 2. Thus, a magenta image is formed on the recording paper 2. After that, a cyan image is formed on the recording paper 2 by thermally transferring the cyan ink component on the recording paper 2 in the similar manner. After each color image is thus sequentially formed on the recording paper 2, an image formation plane of the recording paper 2 is coated by thermally transferring the coating component of the clear region 34 outside of each color component.

Figure 4:
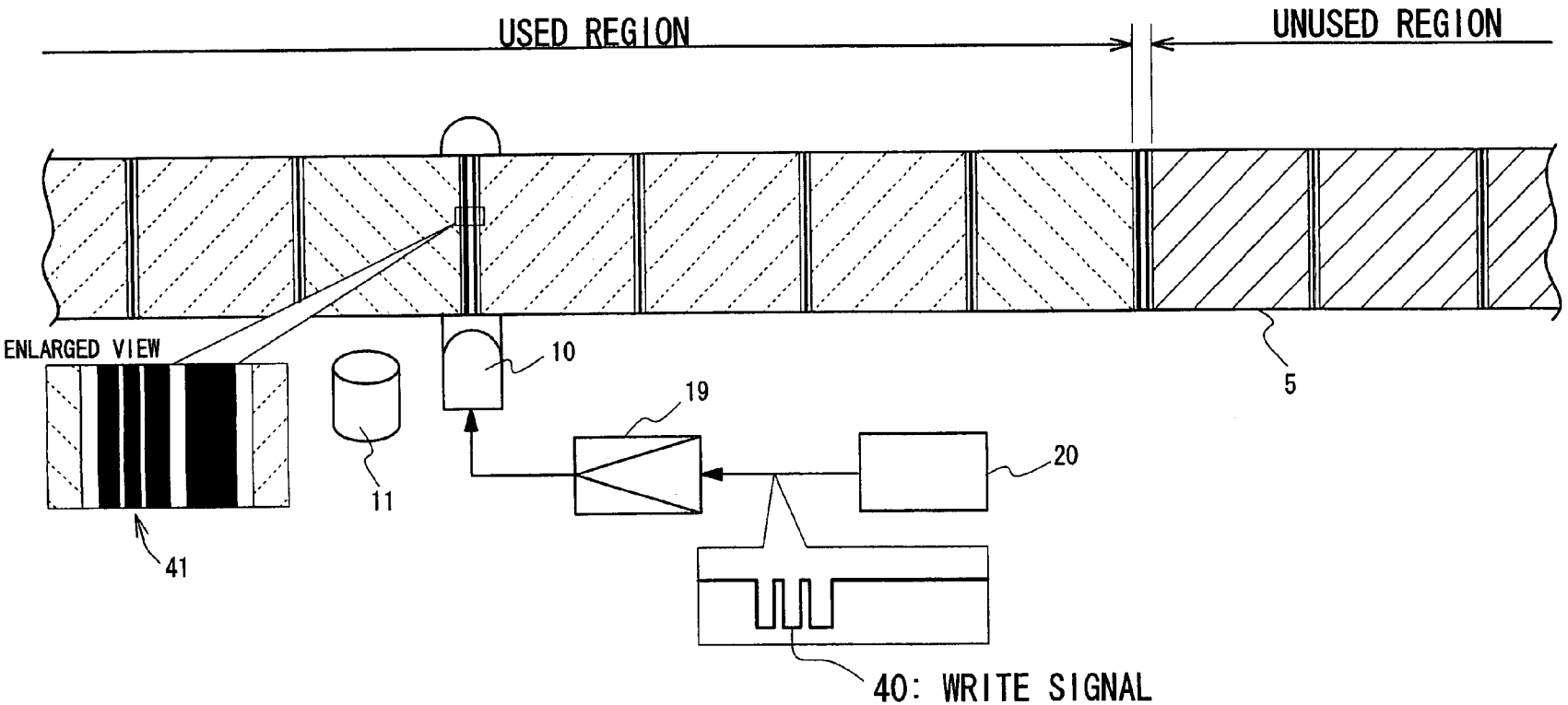
FIG. 4 is a view showing a main part of the printer in a state where a thermal head is preheated.

FIG. 4 is a view showing a main part of the printer 1 in a state where a thermal head 10 is preheated. In the printer 1, when the thermal head 10 is preheated, a write signal 40 for writing used information 41 into the first mark pattern 35 is output from the microcomputer 20 to the buffer amplifier 19. The thermal head 10 writes the used information 41 into the first mark pattern 35 on the basis of the write signal 40 received through the buffer amplifier 19. In this embodiment, the black ink component of the black ink strip located at further downstream side of two black ink strips constituting the first mark pattern 35 is sublimated into two lines and transferred on the recording paper 2. Thus, the used information 41 in the form of two lines corresponding to the write signal 40 is written into the first mark pattern 35.

In the printer 1, after turn-on of an electric power, the nearest first mark pattern 35 is read by the optical sensor 11 and based on a read signal, the start of the unused region of the ink ribbon 5 is located. That is, when the optical sensor 11 reads the signal corresponding to the write signal 40 (used information 41) from the first mark pattern 35, it is judged that the successive yellow region 31, magenta region 32, cyan region 33 and clear region 34 downstream from the first mark pattern 35 have been already used. On the other hand, when the optical sensor 11 does not read the signal corresponding to the write signal 40 from the first mark pattern 35, it is judged that the successive yellow region 31, magenta region 32, cyan region 33 and clear region 34 downstream from the first mark pattern 35 are unused.

Figure 5:
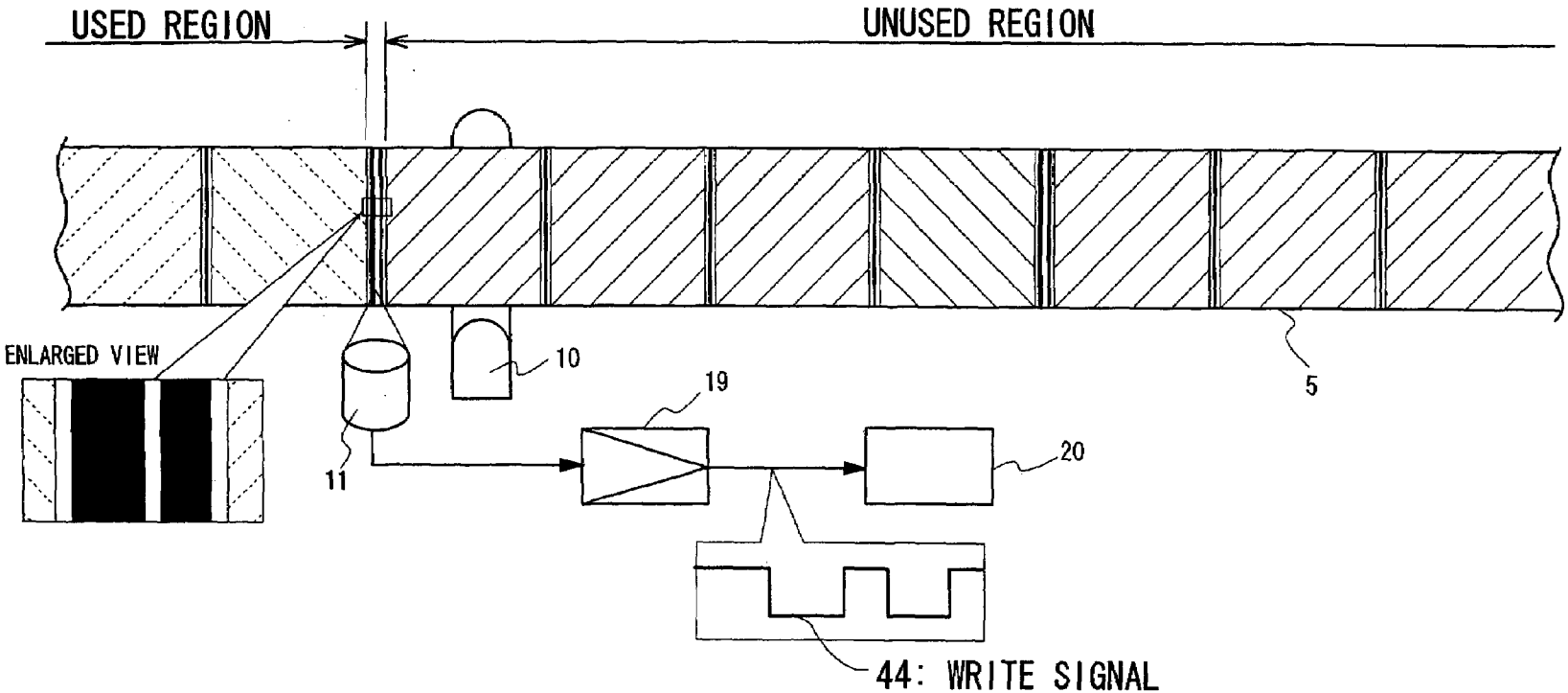
FIG. 5 is a view showing a main part of the printer in a state where an optical sensor reads a mark pattern immediately after image formation.

FIG. 5 shows a state where the optical sensor 11 reads the nearest first mark pattern 35 immediately after the image is formed according to the above-mentioned procedure. In this case, since the thermal head 10 is not preheated, the used information 41 is not formed in the first mark pattern 35. Thus, a read signal 44 read by the optical sensor 11 does not correspond to the write signal 40, so that it is judged that the consecutive regions downstream from the first mark pattern 35 are unused regions. In this case, by driving the ink ribbon drive mechanism 8, the ink ribbon 5 is wound back so that the first mark pattern 35 is opposed to the thermal head 10. Thus, the start of the unused region of the ink ribbon 5 can be located to start printing processing.

Figure 6:
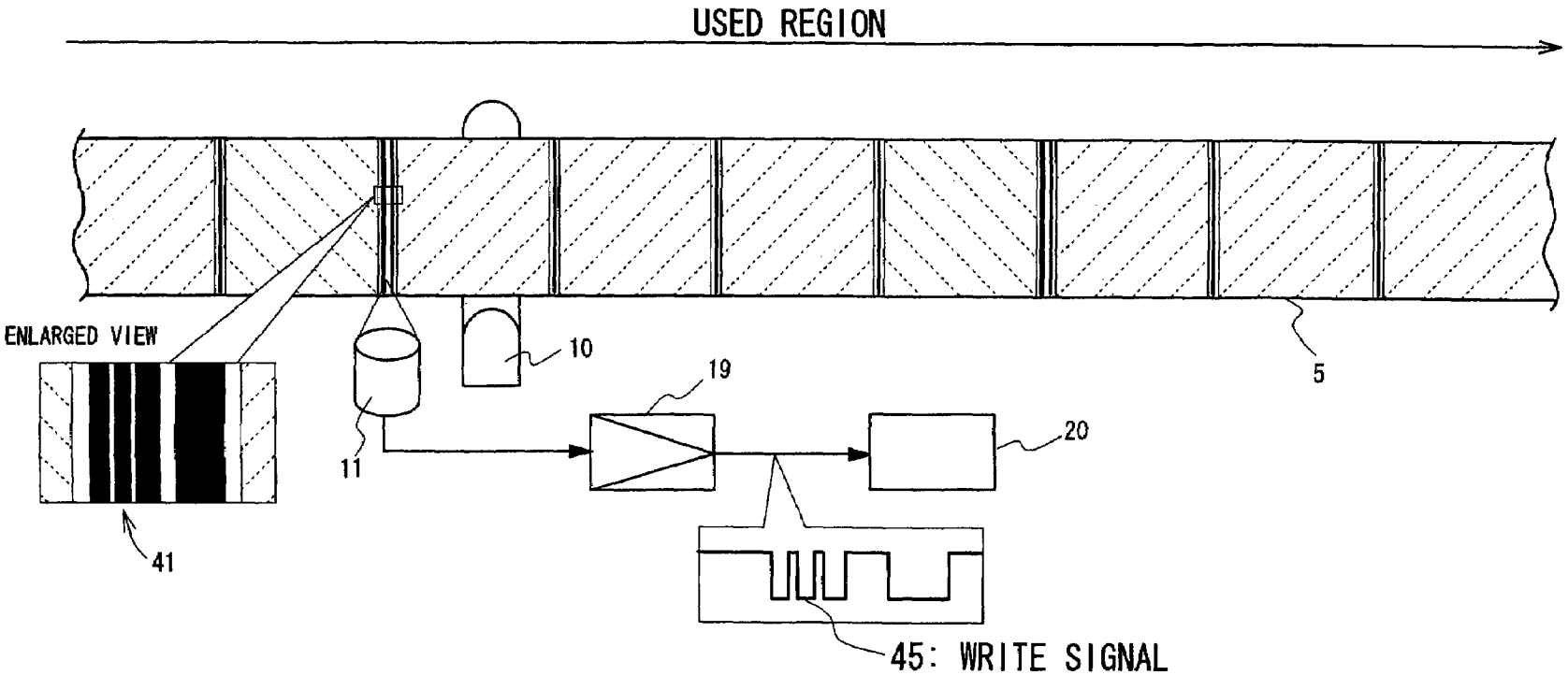
FIG. 6 is a view showing a main part of the printer in a state where the ink ribbon intentionally wound back by the user is loaded.

FIG. 6 shows a state where the optical sensor 11 reads the nearest first mark pattern 35 when the ink ribbon 5 intentionally wound back by the user is loaded. In this case, the used information 41 is formed in the first mark pattern 35 in the used region. Thus, the read signal 45 read by the optical sensor 11 corresponds to the write signal 40, so that it is judged that the consecutive regions downstream from the first mark pattern 35 are used regions. In this case, by driving the ink ribbon drive mechanism 9 until the optical sensor 11 detects the first mark pattern 35 in a rearward position, in which the used information 41 is recorded, the start of the unused region of the ink ribbon 5 is located. Thus, even when the user winds back the ink ribbon 5 intentionally, the start of the unused region of the ink ribbon 5 can be located to start printing processing.

As described above, in the printer 1 in this embodiment, since the used information 41 is recorded in the first mark pattern 35 formed on the ink ribbon 5 prior to image formation, even when the ink ribbon 5 intentionally wound back by the user is loaded, the start of the unused region can be located and normal printing can be performed. Furthermore, by counting the used information 41 read by the optical sensor 11, residual quantity of the ink ribbon 5 can be calculated accurately. Still furthermore, since the used information 41 is recorded in the first mark pattern 35 for alignment, which is originally formed on the ink ribbon 5, no increase in cost of the ink ribbon 5 occurs. Still furthermore, since the used information is recorded in the ink ribbon 5 when the thermal head 10 is preheated, both of time necessary for preparation of the printing operation and recording paper are not consumed uselessly.

The present invention is not limited to the configuration of the above-mentioned embodiment and various modifications are possible. For example, the used information 41 may not necessarily be recorded in the first mark pattern 35 and may be recorded in the second mark patterns 36, 37 and 38 sequentially. Alternatively, the used information 41 may be recorded in any one of the second mark patterns 36, 37 and 38. The mark patterns and write signal may not necessarily be shown in graphic form. For example, a wider strip of mark pattern and a write signal representing the number of sheets accumulated from the front end of the ink ribbon 5 may be adopted. Reading of the used information 41 by the optical sensor 11 may not necessarily be performed at turn-on, and may be performed before the printer 1 starts printing after standby for a predetermined period or longer, for example.

The present invention is not necessarily limited by the above-mentioned embodiment. It is sufficient that the thermal transfer printer comprises: at least one ink ribbon drive mechanism for rotationally driving a feed roll and a take-up roll around which a long ink ribbon on which an ink component and a transparent coating component are sequentially formed in its longitudinal direction; a thermal head for thermally transferring at least one ink component and a coating component on a recording paper and forming an image on the recording paper by heating the ink ribbon; and a control means for controlling each part. A mark pattern for aligning the ink ribbon with respect to the thermal head is formed in each gap between the coating component and an ink component of the ink ribbon. An optical sensor for reading the mark pattern is provided in the vicinity of the thermal head. Before the thermal head thermally transfers the ink component on the recording paper, the control means makes the mark pattern record predetermined information by sublimating a part of the mark pattern adjacent to a region of the ink component. When the optical sensor reads the predetermined information from the mark pattern, the control means detects a front end of an unused region of the ink ribbon based on the predetermined information.

By such a configuration, since the used information is recorded in the mark pattern formed on the ink ribbon, even when the ink ribbon intentionally wound back by the user is loaded, before image formation, the start of the unused region can be located and normal printing can be performed. Furthermore, by counting the used information read by the optical sensor, residual quantity of the ink ribbon can be calculated accurately. Still furthermore, since the used information is recorded in the first mark pattern for alignment, which is originally formed on the ink ribbon, no increase in cost of the ink ribbon occurs.

Furthermore, it is possible that the mark pattern is at least one strip of an ink component formed in the direction perpendicular to the longitudinal direction of the ink ribbon.

Still furthermore, it is possible that the predetermined information is recorded on the mark pattern after forming an image on a recording paper, and the control means judges that a portion of the ink ribbon downstream from the mark pattern on which the predetermined information is recorded has been used.

Still furthermore, it is possible that the ink ribbon has a plurality of ink components of different colors, a first mark pattern is formed in each gap between the coating component and an ink component of the ink ribbon, and a second mark pattern is formed in each gap between an ink component and another ink component.

Still furthermore, it is possible that the firs mark pattern is two strips of an ink component formed in the direction perpendicular to the longitudinal direction of the ink ribbon, and the second mark pattern is one strip of the same ink component as that of the first ink mark pattern formed in the direction perpendicular to the longitudinal direction of the ink ribbon.

Still furthermore, it is possible that the predetermined information is recorded on the first mark pattern after forming an image on a recording paper, and the control means judges that a portion of the ink ribbon downstream from the mark pattern on which the predetermined information is recorded has been used.

This application is based on Japanese patent application 2004-200427 filed Jul. 7, 2004 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A thermal transfer printer comprising:

at least one ink ribbon drive mechanism for rotationally driving a feed roll and a take-up roll around which a long ink ribbon on which an ink component and a transparent coating component are sequentially formed in its longitudinal direction;

a thermal head for thermally transferring at least one ink component and a coating component on a recording paper and forming an image on the recording paper by heating the ink ribbon; and a control means for controlling each part; wherein a mark pattern for aligning the ink ribbon with respect to the thermal head is formed in each gap between the coating component and an ink component of the ink ribbon;

an optical sensor for reading the mark pattern is provided in the vicinity of the thermal head;

before the thermal head thermally transfers the ink component on the recording paper, the control means makes the mark pattern record predetermined information by sublimating a part of the mark pattern adjacent to a region of the ink component onto the recording paper; and when the optical sensor reads the predetermined information from the mark pattern, the control means detects a front end of an unused region of the ink ribbon based on the predetermined information.

2. The thermal transfer printer in accordance with claim 1, wherein the mark pattern is at least one strip of an ink component formed in the direction perpendicular to the longitudinal direction of the ink ribbon.

3. The thermal transfer printer in accordance with claim 1, wherein the predetermined information is recorded on the mark pattern after forming an image on a recording paper; and the control means judges that a portion of the ink ribbon downstream from the mark pattern on which the predetermined information is recorded has been used.

4. The thermal transfer printer in accordance with claim 1, wherein the ink ribbon has a plurality of ink components of different colors;

a first mark pattern is formed in each gap between the coating component and an ink component of the ink ribbon; and a second mark pattern is formed in each gap between an ink component and another ink component.

5. The thermal transfer printer in accordance with claim 4, wherein the firs mark pattern is two strips of an ink component formed in the direction perpendicular to the longitudinal direction of the ink ribbon; and the second mark pattern is one strip of the same ink component as that of the first ink mark pattern formed in the direction perpendicular to the longitudinal direction of the ink ribbon.

6. The thermal transfer printer in accordance with claim 5, wherein the predetermined information is recorded on the first mark pattern after forming an image on a recording paper; and the control means judges that a portion of the ink ribbon downstream from the mark pattern on which the predetermined information is recorded has been used.

7. A thermal transfer printer comprising:

at recording paper conveying mechanism for conveying a long recording paper sent from a recording paper roll formed of recording paper wound around a cylindrical core in the longitudinal direction of the recording paper;

at least one ink ribbon drive mechanism for rotationally driving a feed roll and a take-up roll around which a long ink ribbon on which ink components of each color of yellow, magenta and cyan and a transparent coating component are sequentially formed in its longitudinal direction; and a thermal head for thermally transferring the ink components of each color and coating component on a recording paper and forming an image on the recording paper by heating the ink ribbon;

a cutter for cutting the recording paper on which the image is recorded by the thermal head; and a control means for controlling each part, wherein at least one strip-like mark pattern with a predetermined width formed of a black ink component for aligning the ink ribbon with respect to the thermal head is formed between the coating component and the adjacent yellow ink component of the ink ribbon in the direction perpendicular to the longitudinal direction of the ink ribbon;

an optical sensor for reading the mark pattern is provided in the vicinity of the thermal head; and before the thermal head thermally transfers the yellow ink component on the recording paper, the control means preheats the thermal head up to the transfer temperature and by transferring the black ink component constituting the mark pattern on the front end of the recording paper during preheating, makes predetermined used information that an region of ink component adjacent to the mark pattern is used to be recorded on the ink ribbon;

after turn-on of electric power, when the optical sensor reads the used information of the mark pattern, the control means drives the ink ribbon drive mechanism to the downstream side until the optical sensor detects a rearward mark pattern in which the used information is not recorded;

when the optical sensor does not read the used information of the mark pattern, the control means drives the ink ribbon drive mechanism to a position at which the mark pattern is opposed to the thermal head and the start of an used region of the ink ribbon is located prior to image formation; and the control means transfers the recording paper on which the image is formed to the downstream side by the recording paper transfer mechanism and cut the region on which the black ink component is transferred from the region on which the image is formed by the cutter.

* * * * *